US007219653B2

(12) United States Patent
Muraji

(10) Patent No.: US 7,219,653 B2
(45) Date of Patent: May 22, 2007

(54) ELECTRONIC CONTROL THROTTLE BODY

(75) Inventor: Tetsuo Muraji, Odawara (JP)

(73) Assignee: Mikuni Corporation, Tokyo (JP)

( * ) Notice: Subject to any disclaimer, the term of this patent is extended or adjusted under 35 U.S.C. 154(b) by 612 days.

(21) Appl. No.: 10/470,966

(22) PCT Filed: Nov. 8, 2001

(86) PCT No.: PCT/JP01/09772

§ 371 (c)(1),
(2), (4) Date: Jan. 29, 2004

(87) PCT Pub. No.: WO02/38929

PCT Pub. Date: May 16, 2002

(65) Prior Publication Data

US 2004/0124718 A1 Jul. 1, 2004

(30) Foreign Application Priority Data

Nov. 10, 2000 (JP) ..... 2000-342782

(51) Int. Cl.
*F02D 9/10* (2006.01)

(52) U.S. Cl. ..... 123/399; 123/361

(58) Field of Classification Search ..... 123/361, 123/399

See application file for complete search history.

(56) References Cited

U.S. PATENT DOCUMENTS 4,903,936 A * 2/1990 Kajiwara ..... 123/399
4,911,125 A 3/1990 Sugawara et al.
4,986,238 A * 1/1991 Terazawa ..... 123/361
5,092,420 A 3/1992 Sugawara et al.
5,265,572 A * 11/1993 Kadomukai et al. ..... 123/399
6,575,427 B1 * 6/2003 Rauch et al. ..... 123/399

FOREIGN PATENT DOCUMENTS

| | | |
|---|---|---|
| BR | 9905512 | 9/2000 |
| DE | 39 40 681 | 6/1990 |
| DE | 41 33 380 | 4/1993 |
| DE | 44 41 856 | 5/1996 |
| EP | 0 290 980 | 11/1988 |
| EP | 0 336 340 | 10/1989 |
| EP | 1 002 943 | 5/2000 |
| EP | 1 061 636 | 12/2000 |
| JP | 64-056927 | 3/1989 |
| JP | 06-093888 | 4/1994 |
| JP | 08-230638 | 9/1996 |
| JP | 09-191622 | 7/1997 |
| JP | 11-356028 | 12/1999 |
| JP | 2000-161086 | 6/2000 |
| JP | 2000-240474 | 9/2000 |
| WO | 99/45627 | 9/1999 |

* cited by examiner

*Primary Examiner*—Erick Solis
(74) *Attorney, Agent, or Firm*—Wenderoth, Lind & Ponack, L.L.P.

(57) ABSTRACT

An electronically controlled throttle body has a torque motor including a stator and a moving portion (a slider), and a throttle shaft which is rotated by the torque motor. A rack as a plurality of gear teeth is formed at the moving portion, and a gear which mates with the rack is disposed at the throttle shaft. By arranging the radius of the gear appropriately to the reciprocating range of the slider, the motion of the slider is transmitted to the throttle shaft effectively. Therefore, the electronically controlled throttle body, can efficiently transmit motion of the torque motor, including a linear type, to the throttle shaft with a simple structure.

16 Claims, 9 Drawing Sheets

(a)

(b)

ELECTRONIC CONTROL THROTTLE BODY

TECHNICAL FIELD

This invention relates to an electronically controlled throttle body which is driven by a motor.

BACKGROUND ART

FIG. 7 is a sectional view showing a structure of a conventional electronically controlled throttle body. The throttle body 1 has a circular bore 2*a* at the center of a main body 2, and a circular-disc-shaped throttle valve 3 is disposed therein. The throttle valve 3 is fixed with two screws 5, 5 to a throttle shaft 4 which pierces the bore 2*a*, and is free to rotate from the position to close the bore 2*a* to a full-open position being parallel to the center axis of the bore 2*a*. The rotating range is 90 degrees at the maximum, and no more range is needed.

A motor 6 is integrally attached to the throttle body 1, and the shaft of the motor 6 is integral with the throttle shaft 4. Here, by changing the power supply direction, the throttle shaft 4 turns in the opening direction or the closing direction.

A torque motor is adopted as the motor 6. In general, a torque motor has characteristics of having excellent responsiveness and high reliability since there is no contact. The motor 6 of this kind generally has a rotor to which a ring-shaped magnet is fixed, and controls a rotating position in accordance with changes of magnetic flux distribution formed by a coil and a magnetic path.

As mentioned above, with the throttle body 1, the rotating range of the throttle valve to open and close the bore 2*a* is 90 degrees at the maximum. For example, when an inclination of about 5 degrees is set at idling, the rotating range becomes about 85 degrees. Consequently, the rotating range of the throttle valve 3 is 90 degrees or less. To drive and control within this range, the magnet is not needed over the whole circumference. In addition, the magnet used for the rotor is expensive since the magnetic flux density has to be high.

Therefore, a torque motor 10 utilizing segment type magnets was devised, as shown in FIG. 8. A rotor 11 of this figure is connected directly to the throttle shaft 4 in FIG. 7. About two thirds of the circumference of the rotor 11 is covered by two segment type magnets 12, 12. Since the magnet is downsized by changing from a ring-shape to a segment type, the cost can be reduced. An air-gap is formed between the circumference face of the magnets 12, 12 and a yoke 13. Another air-gap is formed between the circumference face of the magnets 12, 12 and a core 14. A coil 15 is disposed at the core 14.

Parts of the yoke 13 corresponding to the magnet 12, 12 are first and second magnetic sides 13*a*, 13*b* whose top end faces are arc-shaped. Similarly, a part of the core 14 corresponding to the magnet 12, 12 is a third magnetic side 14*a* whose top end face is arc-shaped. Then, these three magnetic sides 13*a*, 13*b*, 14*a* are located on the same arc. Further, a stator is constructed by the yoke 13, the core 14 and the coil 15, and a moving portion is constructed by the rotor 11 and the magnets 12, 12.

When electric current is supplied to the coil 15, the rotor 11 rotates around the axis O, and the throttle valve 3 which is directly connected to the rotor 11 opens and closes. The rotating direction of the rotor 11 changes in accordance with the direction of the electric current which passes through the coil 15. With the above-mentioned torque motor 10, the rotating angle of the rotor 11 is about 120 degrees, because the magnets 12, 12 cover about two thirds of the circumference of the rotor 11.

However, as mentioned above, since the rotating angle of the throttle shaft 4 is approximately between 85 degrees and 90 degrees, the use of the torque motor 10 in FIG. 8 is not efficient.

Further, the above-mentioned torque motor 10 has a characteristic that the torque generated at both ends is lower than the torque generated at the center of the rotating range. This seems to be caused by magnetic circuit problems, such as the magnetizing angle of the magnet, the magnetic saturation of the magnetic poles, and so on. On the contrary, in a normal usage situation, the throttle valve 3 is operated with approximately equal torque from the full-close position to the full-open position. Therefore, it is desirable to obtain a flat torque characteristic. Further, considering freezing in the winter, it is more desirable that the torque at the full-close position is the maximum torque.

For efficiency, adopting a speed reduction mechanism which transmits the rotating angle of the rotor 11 to the throttle shaft 4 via a speed reducer to reduce the angle has been considered. However, having a separate speed reducing mechanism is not desirable since it increases the size of the throttle body. Further, the cost increases because the number of parts increases.

On the other hand, as shown in FIG. 9, adopting a linear type torque motor 20 to obtain a flat torque characteristic has been considered. The torque motor 20 is disclosed in patent application No. 2000-4107 which was previously submitted by the same applicant as this application. The torque motor 20 shown in FIG. 9 has a first stator 21 shaped almost like a rectangle, a second stator 22 shaped like three sides of a shallow rectangle which is disposed with a gap 23 to the first stator 21, an electromagnetic coil 24 which is disposed between the first stator 21 and the second stator 22, a slider 25, and two magnetized members 26, 27 which are attached to the slider 25. The magnetized members 26, 27 are plate-shaped magnets which have magnetic poles in the thickness direction (the vertical direction in FIG. 9), and disposed so that the magnetic polarities of the magnetized members 26, 27 which are adjacent to each other are opposite to each other.

The first stator 21 has two magnetic sides 21*a*, 21*b*, and the second stator 22 has one magnetic side 22*a*. These three magnetic sides are located in a line, and a gap 28 is maintained between the magnetized members 26, 27 of the slider 25 and the magnetic sides 21*a*, 21*b*, 22*a*.

With the linear type torque motor 20, a stator is structured by the first stator 21, the second stator 22 and the electromagnetic coil 24, and a moving portion is structured by the slider 25 and magnetized members 26, 27. Then, in accordance with the direction of electric current to the electromagnetic coil 24, the slider moves in both directions shown by the arrow.

Here, the actuating force applied to the slider 25 is almost constant no matter where the slider 25 is positioned. Therefore, by transmitting the movement of the slider 25 to the throttle shaft 4, the rotating torque which is applied to the throttle shaft 4 can be almost constant.

However, to convert linear motion of the slider 25 to rotating motion of the throttle shaft 4, separate parts are needed and the structure is complicated.

The present invention is devised in consideration of the above-mentioned facts, and the object is to provide an electronically controlled throttle body which can efficiently transmit the motion of a torque motor, including a linear torque motor, to a throttle shaft with a simple structure.

SUMMARY OF THE INVENTION

In order to achieve the above-mentioned object, the electronically controlled throttle body of the present invention comprises a torque motor which has a stator and a moving portion, and a throttle shaft which is rotated by the torque motor, wherein a plurality of gear teeth is formed at the moving portion, and a gear which mates with the plurality of gear teeth is disposed at the throttle shaft.

Further, it is possible to adopt a structure such that the stator has three magnetic sides which are disposed approximately on a same locus, the moving portion is movable in two directions within a specific range having two magnetized members which face the three magnetic sides of the stator, and the plurality of gear teeth of the moving portion is formed at the moving portion where the magnetized portion is not disposed.

Here, the moving portion can be formed by laminating a plurality of thin plates of ferromagnetic material. It is also possible to adopt a structure such that the three magnetic sides are located approximately in a line, the moving portion is a slider which reciprocates on a line, and the plurality of gear teeth is a rack which is formed at the slider. It is also possible to adopt a structure such that the three magnetic sides are located approximately on an arc, and the moving portion is a rotor which is rotatable in a range of less than 360 degrees. Here, both the plurality of gear teeth of the rotor and the gear of the throttle shaft can be non-circular gears.

BRIEF DESCRIPTION OF THE DRAWINGS

FIG. 4 (*a*) corresponds to FIG. 2 of the first embodiment, and FIG. 4(*b*) corresponds to FIG. 1 of the first embodiment.

BEST MODE FOR CARRYING OUT THE INVENTION

Figure 1:
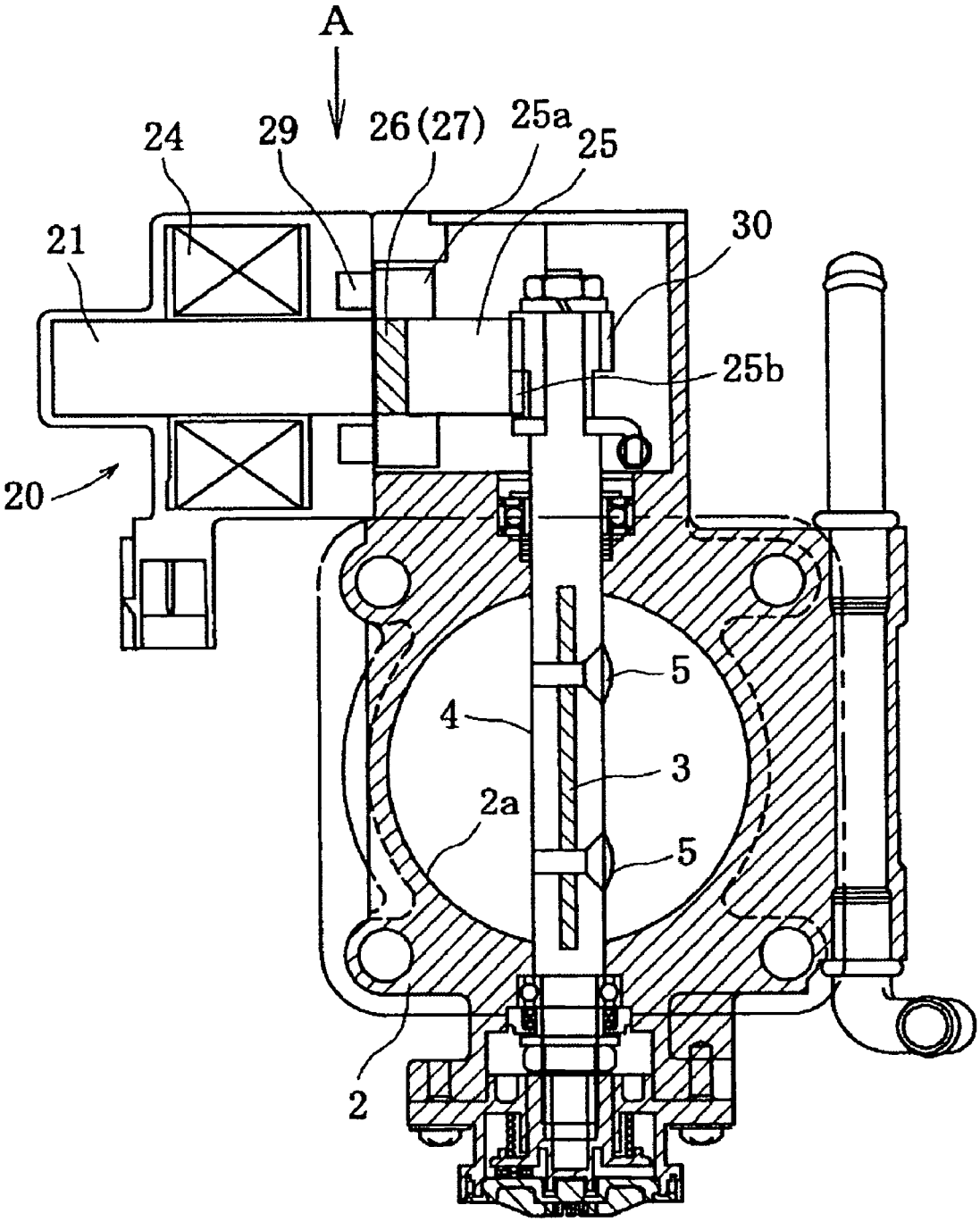
FIG. 1 is a sectional view of an electronically controlled throttle body structure of the first embodiment of the present invention in which a linear type torque motor is adopted as driving means.
Figure 2:
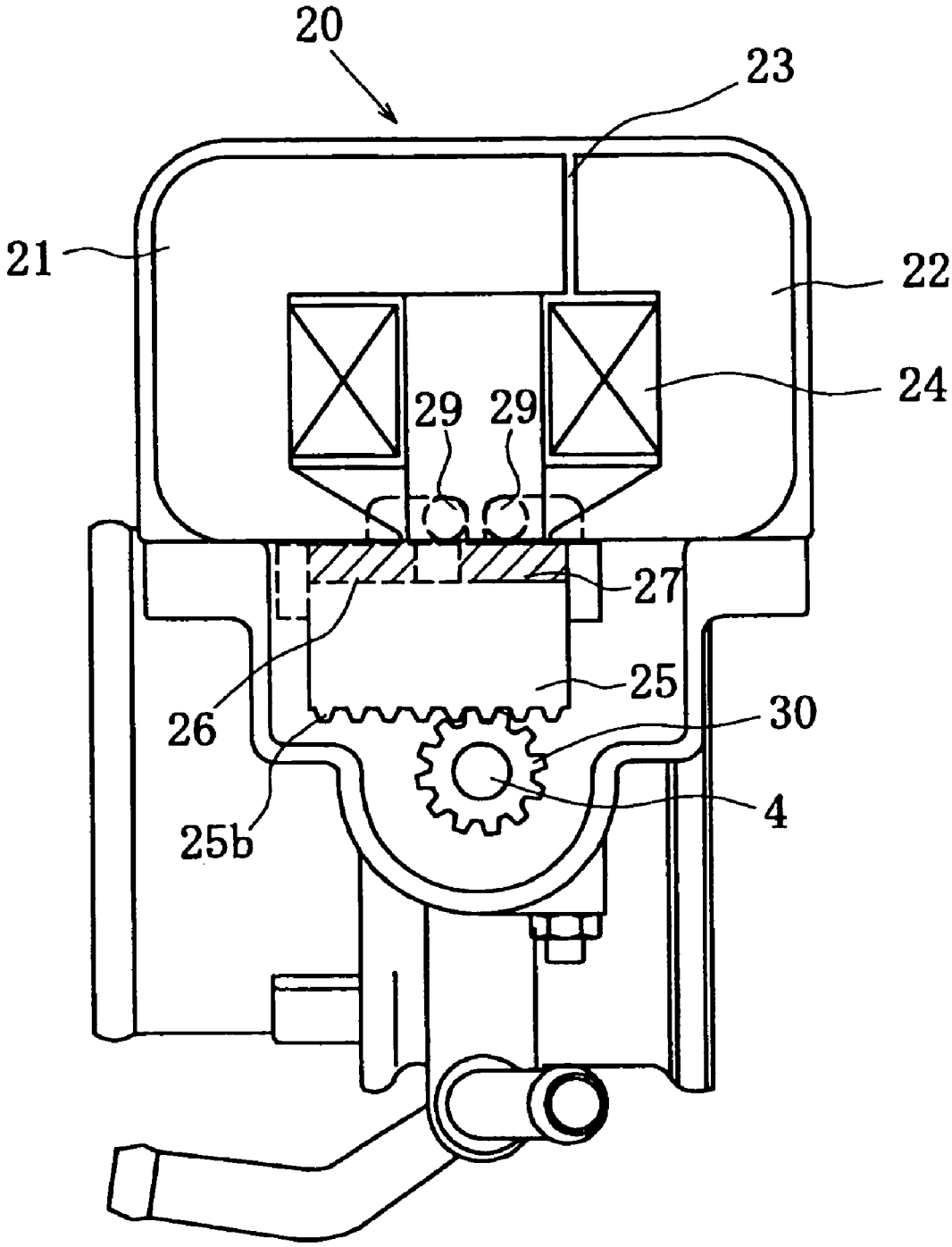
FIG. 2 is a view from A in FIG. 1 showing a stator, a moving portion and its surroundings.

FIG. 1 and FIG. 2 show the first embodiment of the present invention. FIG. 1 is a sectional view of an electronically controlled throttle body structure in which a linear type torque motor is adopted as driving means. FIG. 2 is a view from A in FIG. 1 showing a stator, a moving portion and their surroundings.

Figure 9:
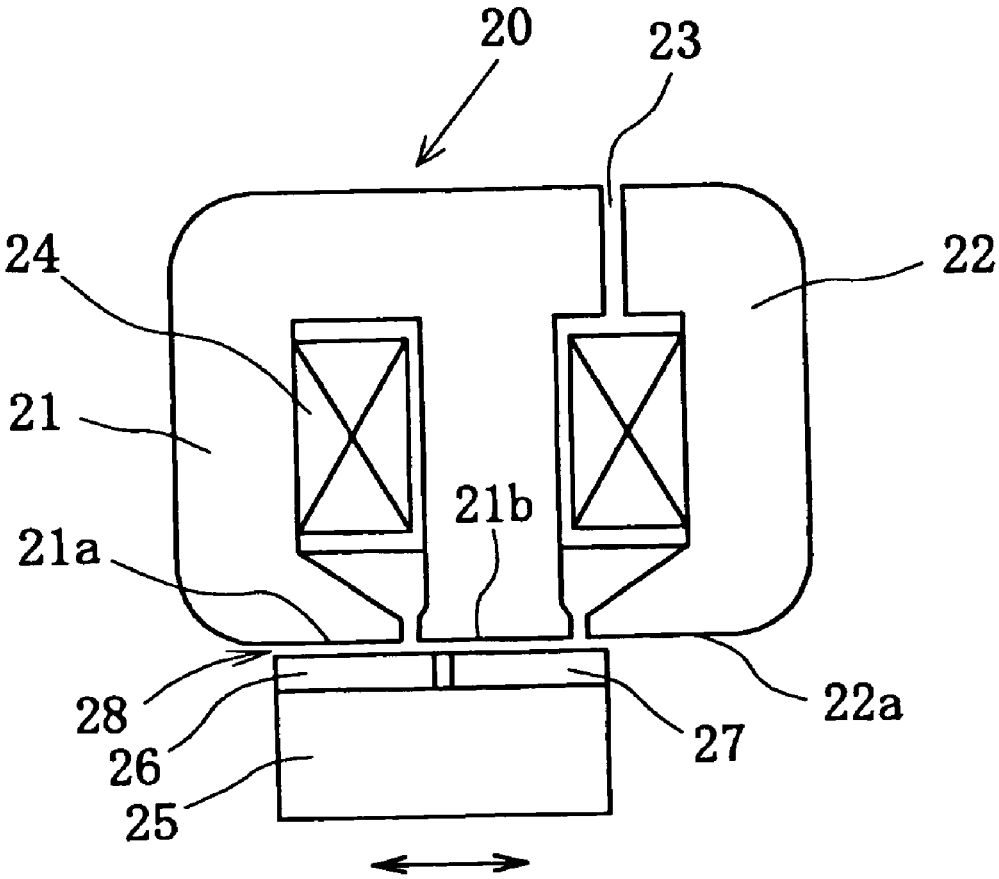
FIG. 9 shows a structure of a conventional linear type torque motor.

With the structure of the linear torque motor 20 in these figures, the same numerical note is given to the same part in FIG. 9. A slider 25 of the linear type torque motor 20 has guides 25*a*, 25*a* at both sides which are in rolling contact with rollers 29, 29 so as to maintain a gap 28 (see FIG. 9).

On the opposite side of magnetized members 26, 27 of the slider 25, a rack 25*b* is formed as a plurality of gear teeth. A gear 30 which mates with the rack 25*b* is fixed to a throttle shaft 4.

Figure 3:
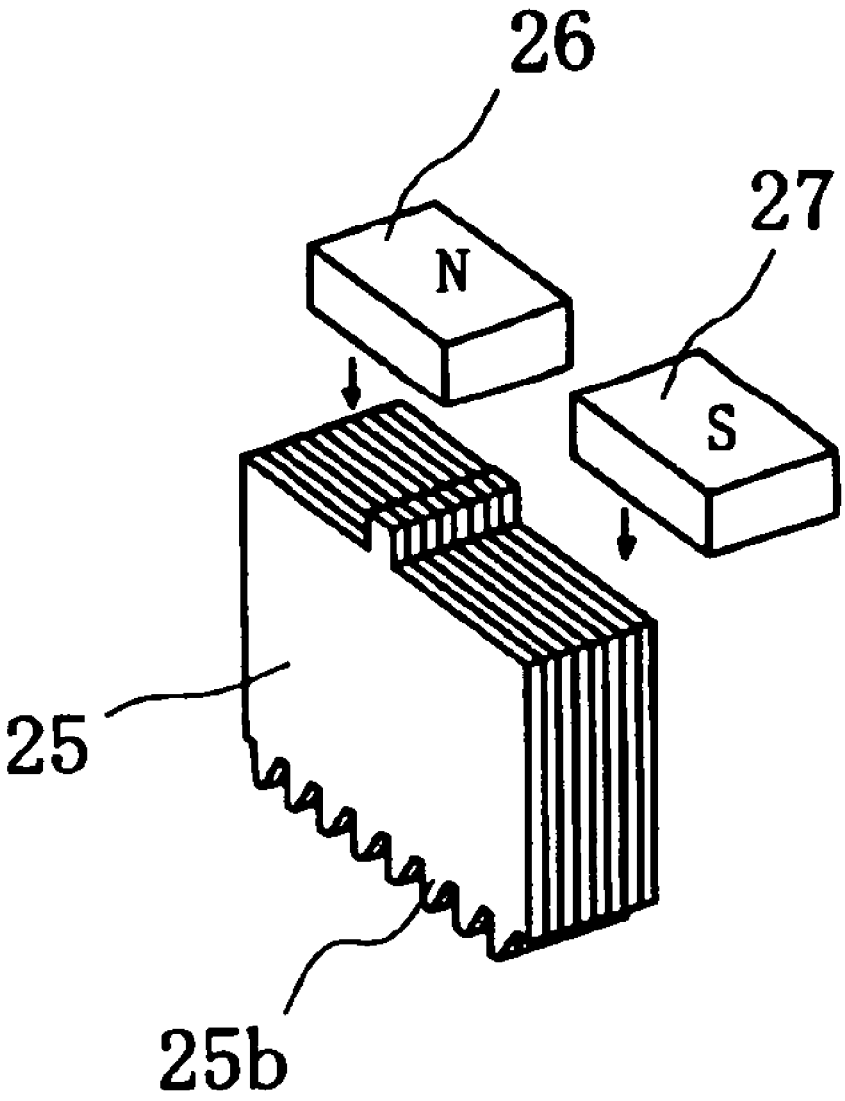
FIG. 3 is an exploded perspective view showing around a slider and a magnetized member.

FIG. 3 is an exploded perspective view showing around the slider 25 and the magnetized members 26, 27. The slider 25 is constructed by laminating a plurality of plates of ferromagnetic material, such as steel plates. When each thin plate is formed by press working, namely, by being cut out of a base thin plate, the rack 25*b* can be formed simultaneously. Therefore, gear cutting is not needed, and the rack 25*b* can be formed easily.

The slider 25 reciprocates within the movable range of the linear type torque motor 20. Since the rack 25*b* is mated with the gear 30, the throttle shaft 4 rotates. Here, when the radius of the gear 30 is arranged so that the movable range of the slider 25 fully overlaps the rotating range of the throttle shaft 4, the whole movable range of the linear type torque motor 20 can be utilized effectively, and waste can be avoided. Since the throttle shaft 4 rotates only up to 90 degrees, the gear 30 can be a sector gear.

As explained above, with the aforementioned embodiment, the linear motion of the linear type torque motor 20 can be converted to the rotating motion of the throttle shaft 4 with a very simple structure, and the linear type torque motor capacity can be fully used.

Figure 4:
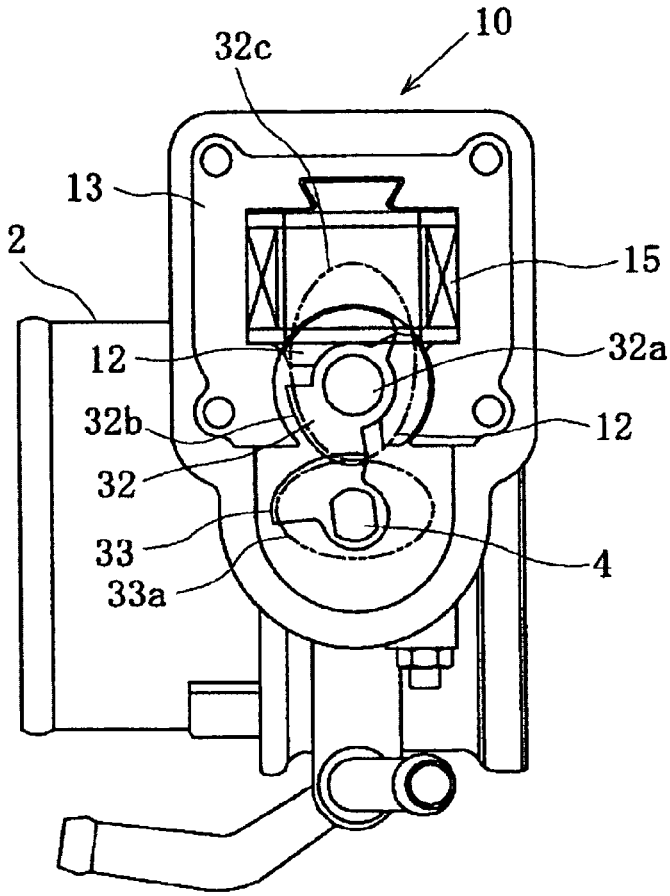
FIGS. 4(*a*) and 4(*b*) show a second embodiment of the present invention utilizing a torque motor which has a rotor as a moving portion.
Figure 4:
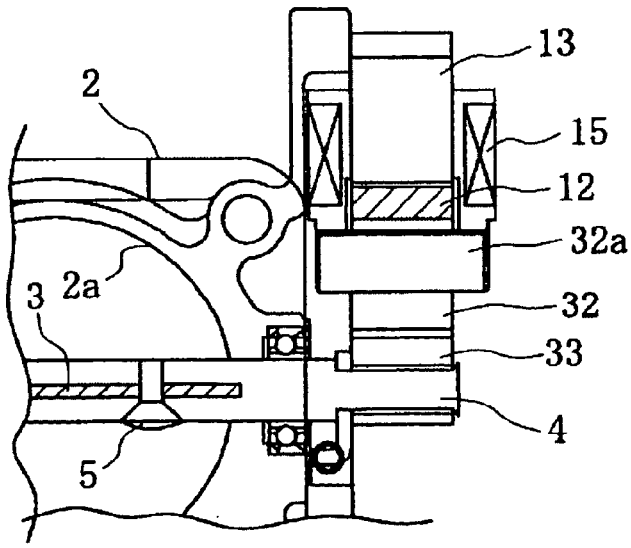
Figure 8:
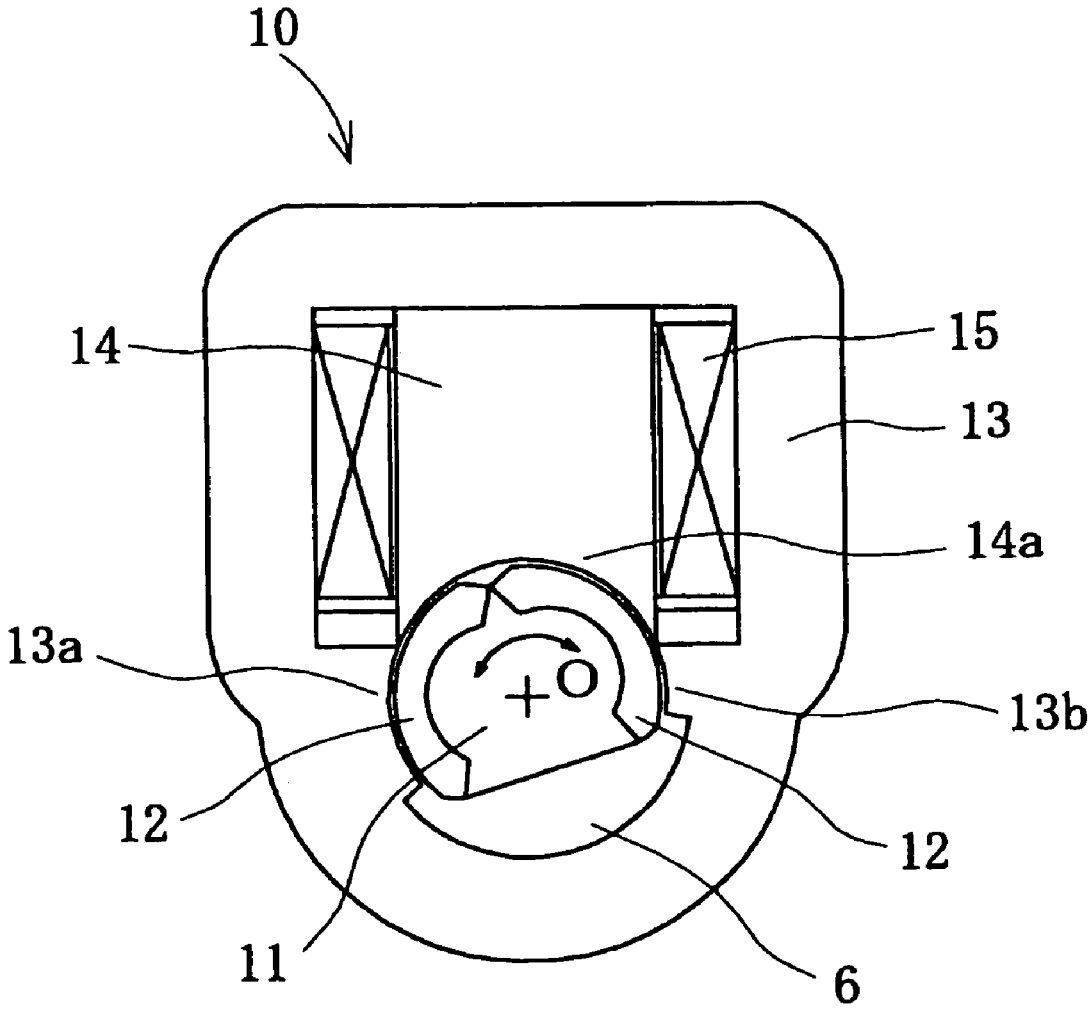
FIG. 8 shows a structure of a conventional torque motor utilizing segment type magnets.

FIGS. 4(*a*) and 4(*b*) show a second embodiment of the present invention utilizing a torque motor 10 which has a rotor as a moving portion. FIG. 4 (*a*) corresponds to FIG. 2 of the first embodiment, and FIG. 4(*b*) corresponds to FIG. 1 of the first embodiment. The torque motor 10 has the same structure as explained in FIG. 8. While the throttle shaft 4 is directly connected to the rotor 11 in the prior art, the throttle shaft 4 is disposed separately from the shaft 32*a* of the rotor 32 in this embodiment.

Figure 5:
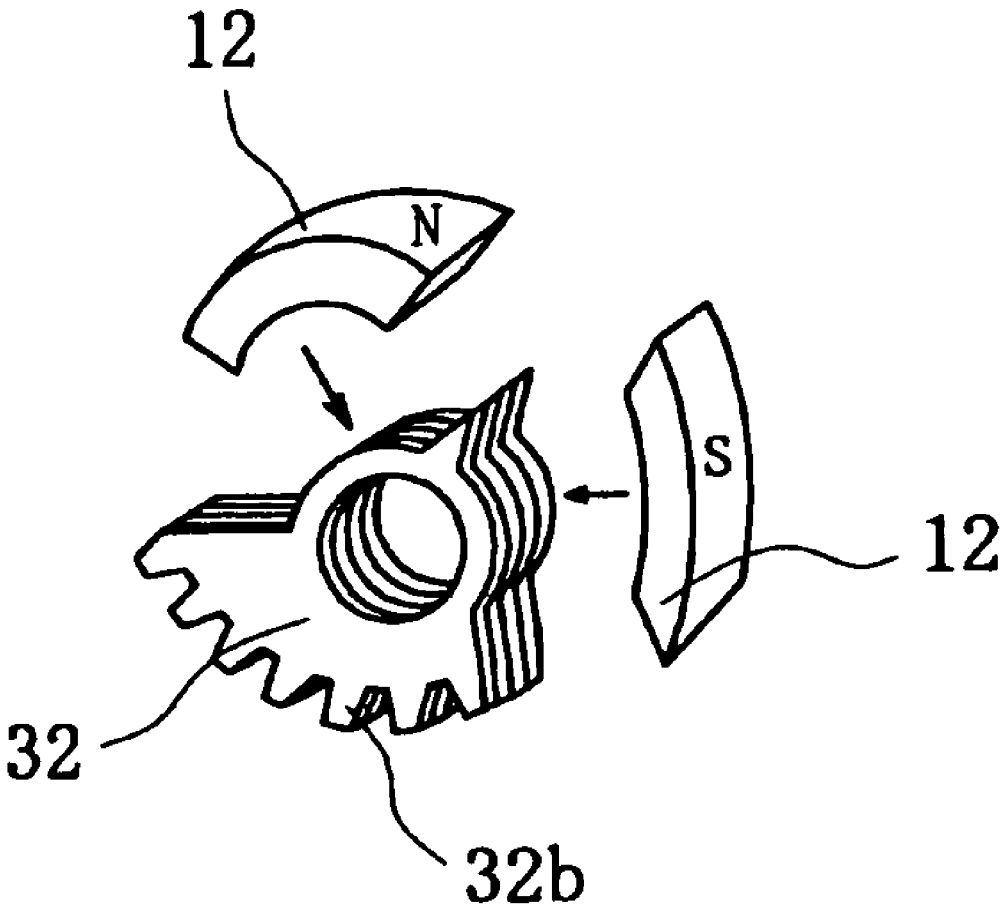
FIG. 5 is an exploded perspective view showing a rotor and magnetized members.

FIG. 5 is an exploded perspective view showing around a rotor 32 and magnetized members 12, 12. The rotor 32 is constructed by laminating a plurality of thin plates of ferromagnetic material such as steel plates, and the shaft 32*a* of the rotor pierces through the center holes thereof. At both sides of the rotor 32, the two magnetized members 12, 12 are bonded and fixed. Then, a plurality of the gear teeth 32*b* is formed at the portion of the rotor where the magnetized members 12, 12 are not disposed. When the rotor 32 is cut out of a thin plate, the plurality of the gear teeth 32*b* is simultaneously cut out and formed. Here, in this embodiment, the plurality of the gear teeth 32*b* forms a sector gear being a part of an oval gear whose pitch circle is a vertically oriented oval 32*c*.

A gear 33 which mates to the plurality of the gear teeth 32*b* is attached to the throttle shaft 4. The gear 33 is a sector gear being a part of an oval gear whose pitch circle is a horizontally oriented oval 33*a*.

By adopting these oval gears, the throttle shaft 4 can be rotated with approximately constant rotating torque from the full-close position to the full-open position of the throttle valve 3. Further, by arranging the gear ratio appropriately, the whole movable rotating range of the torque motor 10 can be efficiently utilized for the range of the throttle valve 3 between the full-close position and the full-open position. Furthermore, the structure is simple because the only modification to the prior structure is the oval gears 32*b* and 33. Furthermore, the manufacturing cost is low because the plurality of gear teeth 32*b* as one gear can be simultaneously formed when the rotor 32 is formed.

Although an oval gear is used in the above-mentioned embodiment, it is not limited to this, and various kinds of non-circular gears can be used.

Figure 6:
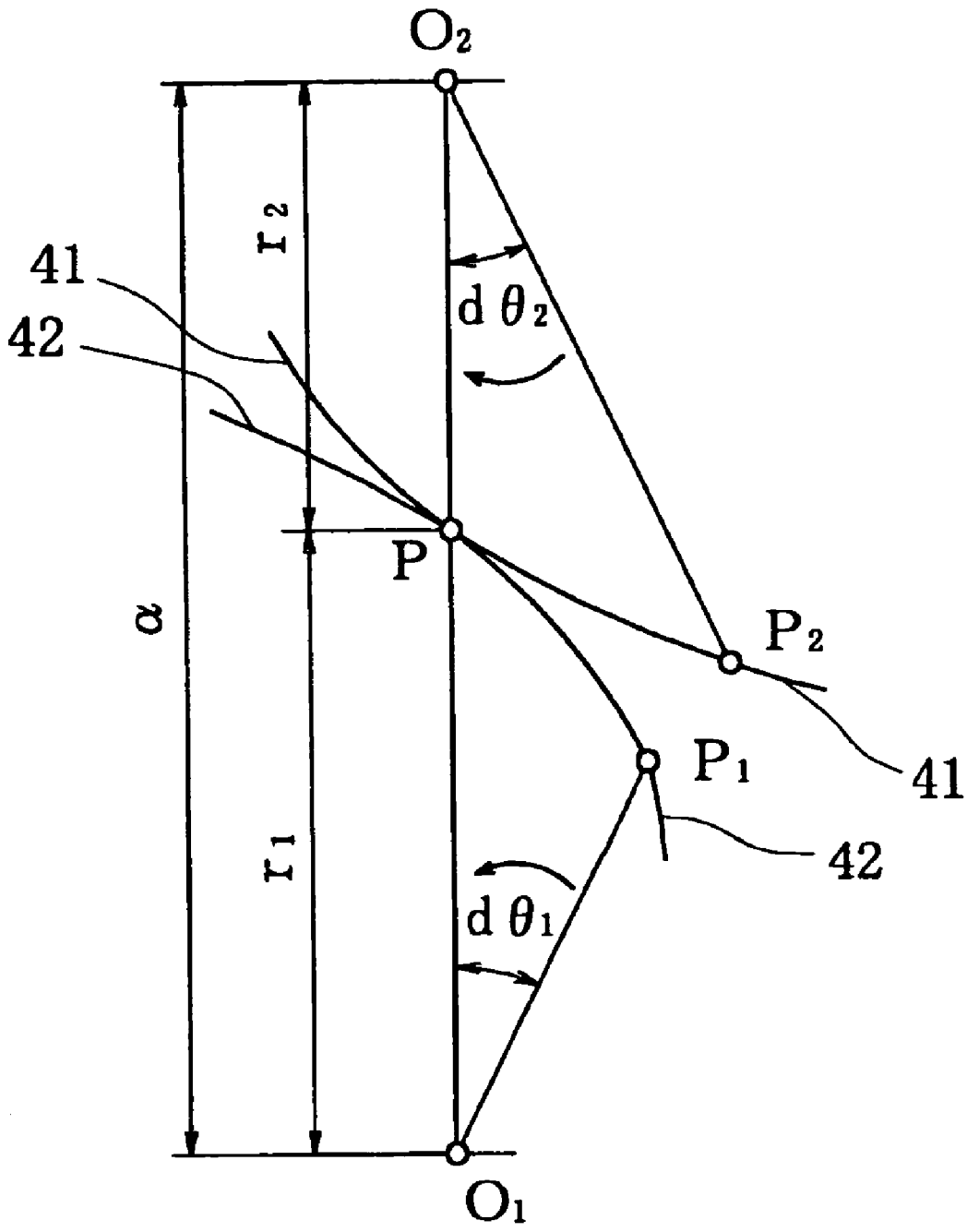
FIG. 6 explains how to determine pitch curve shapes of a non-circular driving gear and a driven gear.
Figure 7:
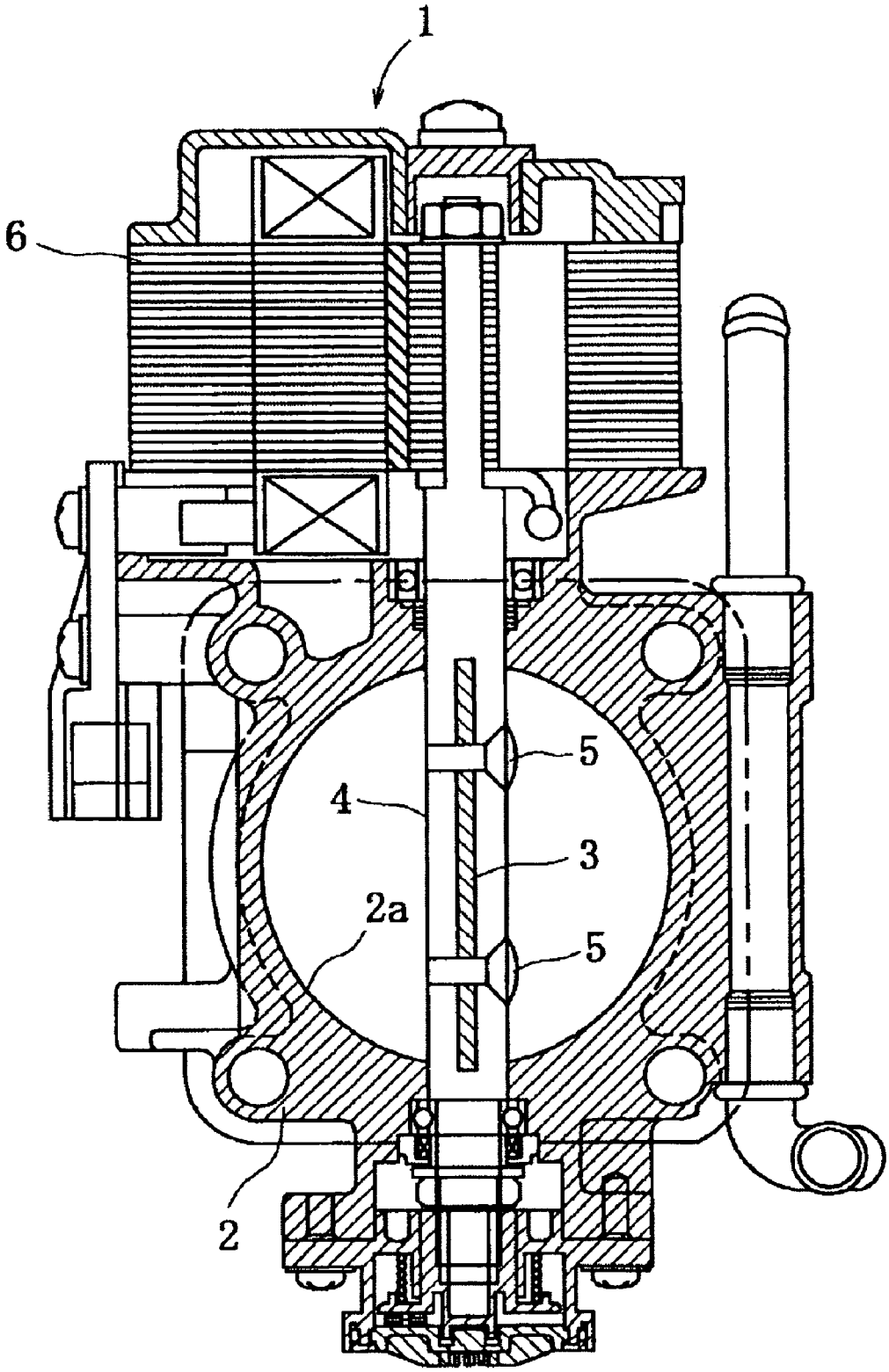
FIG. 7 is a sectional view showing a structure of a conventional electronically controlled throttle body.

FIG. 6 explains how to determine pitch curve shapes of a non-circular driving gear 41 and a driven gear 42. As shown in this figure, the center of the driving gear 41 is O2, the center of the driven gear 42 is O1, and both pitch curves of the driving gear 41 and the driven gear 42 are in contact with each other at point P. Then, if the driving gear 41 rotates clockwise (plus direction) by a small angle d θ2, and the driven gear 42 rotates counter-clockwise (minus direction) by a small angle d θ1, so that point P1 and point P2 are to be in contact with each other, the following equations hold.

$$r1+r2=\alpha \quad (1)$$

$$r1\cdot d\theta 1=r2\cdot d\theta 2 \quad (2)$$

On the condition that α=1, r1 and r2 are given by the equation (1) and equation (2) as follows.

$$r1=(-d\theta 2/d\theta 1)/\{1-(d\theta 2/d\theta 1)\} \quad (3)$$

$$r2=1/\{1-(d\theta 2/d\theta 1)\} \quad (4)$$

Here, −d θ2/d θ1 represents an angular velocity ratio. Therefore, giving the angular velocity ratio to the equation (3) and equation (4), the radiuses r1, r2 of pitch circles at that angle are determined.

Namely, the following equations hold between torque T(θ2) of the torque motor 10 at the rotating angle θ2, and torque T(θ1) which is transmitted to the driven gear.

$$T(\theta 2)=T(\theta 1)\cdot(d\theta 2/d\theta 1) \quad (5)$$

$$=(r1/r2)\cdot T(\theta 1)$$

Given T(θ2), r1 and r2 can be determined by the equations (3), (4) and (5).

Consequently, by drawing a diagram in which desired torque T(θ1) is plotted for every opening θ1 between full-close position and full-open position of the throttle valve 3, the pitch curves of the driving gear 41 and the driven gear 42 are obtained in accordance with the diagram.

Accordingly, when non-circular gears such as the oval gears are used for the plurality of the gear teeth 32*b* as the driving gear 41, and the gear 33 as the driven gear 42, regarding the relations between the throttle shaft opening and the throttle shaft torque, it is possible, for example, that the shaft torque is maintained approximately constant regardless of the shaft opening, or it is also possible that the maximum torque is obtained at the full-close position where the maximum load may be applied.

In addition, as a matter of course, it is possible to adopt a circular gear instead of a non-circular gear, and reduce speed merely by the gear ratio.

INDUSTRIAL APPLICABILITY

As explained above, the electronically controlled throttle body of the present invention comprises a torque motor which has a stator and a moving portion, and a throttle shaft which is rotated by the torque motor, wherein a plurality of gear teeth is formed at the moving portion, and a gear which mates with the plurality of gear teeth is disposed at the throttle shaft. Therefore, by arranging the gear ratio appropriately, the whole operating range of the torque motor can be utilized for the rotating range of the throttle shaft, and the torque motor can be used efficiently. Further, by forming the plurality of the gear teeth at the moving portion, the increase of the number of parts is prevented, and the throttle body can be formed compactly.

Further, with the structure that the moving portion is formed by laminating a plurality of thin plates of ferromagnetic material, the plurality of gear teeth is formed simultaneously at the time when the moving portion is formed. Therefore, cost reduction can be achieved by decreasing machining process time. Further, since the thickness of the plurality of the gear teeth can be kept sufficient, the load applied to the gear which mates with the teeth is distributed. Consequently, the durability improves and the gear can be made of low-cost resin material.

With the structure having the three magnetic sides located approximately in a line, the moving portion is a slider which reciprocates on a line, and the plurality of gear teeth is a rack which is formed at the slider, the linear motion of the linear type torque motor can be converted to the rotating motion of the throttle shaft with a simple structure.

With the structure having the three magnetic sides located on an approximate arc, the moving portion is a rotor which is rotatable within the range of less than 360 degrees, and both the plurality of gear teeth of the rotor and the gear of the throttle shaft are non-circular gears, the desired driving torque can be obtained from the full-close state to the full-open state of the throttle valve.

The invention claimed is:

1. An electronically controlled throttle body, comprising:

a torque motor which has a stator and slider; and a throttle shaft which is rotatable by said torque motor;

wherein said slider has a rack of gear teeth, and said throttle shaft has a gear which mates with said rack of gear teeth, and wherein said stator has three magnetic sides which are disposed approximately on a same locus and located approximately in a line, said slider has two magnetized members which face the three magnetic sides of said stator, said slider is adapted to reciprocate on a line in two directions within a specific range, and said rack of gear teeth of said slider is formed at a portion of said slider where said two magnetized members are not disposed.

2. The electronically controlled throttle body according to claim 1, wherein said slider comprises a plurality of thin plates of ferromagnetic material laminated together.

3. The electronically controlled throttle body according to claim 1, wherein said rack of gear teeth is integrally formed with said slider.

4. The electronically controlled throttle body according to claim 2, wherein each of said plurality of thin plates has a cross-section of said rack of gear teeth integrally formed therein.

5. The electronically controlled throttle body according to claim 1, wherein said gear of said throttle shaft is a sector gear.

6. The electronically controlled throttle body according to claim 2, wherein said gear of said throttle shaft is a sector gear.

7. The electronically controlled throttle body according to claim 3, wherein said gear of said throttle shaft is a sector gear.

8. The electronically controlled throttle body according to claim 4, wherein said gear of said throttle shaft is a sector gear.

9. The electronically controlled throttle body according to claim 1, wherein said gear of said throttle shaft is made of a resin material.

10. The electronically controlled throttle body according to claim 3, wherein said gear of said throttle shaft is made of a resin material.

11. The electronically controlled throttle body according to claim 3, wherein said gear of said throttle shaft is made of a resin material.

12. The electronically controlled throttle body according to claim 4, wherein said gear of said throttle shaft is made of a resin material.

13. The electronically controlled throttle body according to claim 5, wherein said gear of said throttle shaft is made of a resin material.

14. The electronically controlled throttle body according to claim 6, wherein said gear of said throttle shaft is made of a resin material.

15. The electronically controlled throttle body according to claim 7, wherein said gear of said throttle shaft is made of a resin material.

16. The electronically controlled throttle body according to claim 8, wherein said gear of said throttle shaft is made of a resin material.

* * * * *